US005791070A

United States Patent [19]

Gallay

[11] Patent Number: 5,791,070

[45] Date of Patent: Aug. 11, 1998

[54] PLASTIC BINDINGS FOR SNOW SHOES

[76] Inventor: Philippe Gallay, Le Nojak, 74220 La Clusaz, France

[21] Appl. No.: 769,576

[22] Filed: Dec. 19, 1996

Related U.S. Application Data

[63] Continuation of Ser. No. 436,173, May 9, 1995, abandoned.

[30] Foreign Application Priority Data

May 10, 1994 [FR] France ..... 94 05919

[51] Int. Cl.[6] ..... A43B 5/04; A43B 5/16

[52] U.S. Cl. ..... 36/125; 36/122

[58] Field of Search ..... 36/116, 122, 123, 36/124, 125

[56] References Cited

U.S. PATENT DOCUMENTS

| | | | |
|---|---|---|---|
| 2,420,261 | 5/1947 | Nadeau | 36/125 |
| 2,699,613 | 1/1955 | Peterson | 36/125 |
| 3,000,117 | 9/1961 | Howe | 36/125 |
| 3,596,374 | 8/1971 | Covington | 36/125 |
| 3,636,643 | 1/1972 | Lundquist | 36/125 X |
| 4,348,824 | 9/1982 | Treadwell | 36/125 |
| 5,014,450 | 5/1991 | McGrath | 36/124 |

FOREIGN PATENT DOCUMENTS

| | | | |
|---|---|---|---|
| 1080760 | 7/1980 | Canada | 36/122 |

*Primary Examiner*—B. Dayoan

*Attorney, Agent, or Firm*—Fay, Sharpe, Beall, Fagan, Minnich & McKee

[57] ABSTRACT

Snow-shoe consisting of a boot retaining device of the type including a retainer device in front (9) in which is retained the front extremity of said boot, which is there acted upon by at least one pulling device toward the front (11) characterized in that the front retainer device is an elastic envelope made up by a set of walls (15*a*, 15*b*, 15*c*, 15*d*) of pliable material forming a retainer cavity open toward the rear, characterized in that the retainer cavity consists of two lateral retainer walls (15*b*, 15*c*) converging toward the front, and the convergence of which and their distance from each other is such that the front extremity of the boot is maintained laterally by these walls at two lateral points separated from each other.

17 Claims, 7 Drawing Sheets

9
B
A
F
C
R2
R1
L2
15c
10
6
14
15b
L1
O

PLASTIC BINDINGS FOR SNOW SHOES

This is a continuation of U.S. patent application Ser. No. 08/436,173, filed May 9, 1995, now abandoned.

BACKGROUND OF THE INVENTION

The present invention concerns a snow shoe and, more specifically, the boot retaining device on same.

Snow shoes are instruments which have been known for a great many years because they have been utilized for several centuries by the inhabitants of Scandinavia in order to travel on snow. Until now, snow shoes were used for utilitarian or military purposes in order to permit people and mountain troops to move on snow in their everyday travel requirements. At the present time, snow shoes are for the most part utilized by hikers or sportsmen/women who are undertaking hikes or walks, or even engage in competitions.

Different types of devices already exist for retaining the boot on the snow shoe. There have been known, more specifically, two types, one called plate[type] and one called rubber slipper [type]. Generally, the plate-type devices are most often utilized by athletes concerned with performance, because the binding of the foot is assured with greater rigidity. The devices of the rubber slipper type are formed by frontal fitting, realized by an enclosure of rubber in which the front extremity of the boot is retained. But the interior wall of the enclosure destined to receive said front extremity is laterally limited by a curved wall, whose curvature is approximately identical to that of the front of the boot. This results in the possibility of rotation of boot around a point located under the front of the foot, which provokes the chance of lateral displacement of the heel. Retention of the boot is therefore not quite assured. But even if this latter type of retention is, for the most part, preferred by walkers with lower requirements, more so than by sports persons concerned with performances, there remains, nevertheless that said walkers likewise desire excellent holding of their boot.

SUMMARY OF THE INVENTION

The snow shoe according to the invention solves the boot holding problem and is of the type consisting of a front retaining device in which the front extremity of said boot is retained which is acted upon by at least one pulling device toward the front, characterized in that the front retaining device is an elastic envelope made up by a set of walls of pliable material forming a retainer cavity, at least open toward the rear, and is characterized in that the retainer cavity consists of two lateral retainer walls, converging toward the front and the convergence of which and their distance from each other is such that the front extremity of the boot is laterally maintained by these walls in two lateral points separated from each other.

According to a preferred arrangement, the distance between the two lateral retaining points of the boot is made up of half of the width of the boot and the width of same so that the extremity of the boot may be retained by its lateral zones outside the zone of the central front extremity.

According to another advantageous arrangement of the device, the elastic envelope includes a frontal hole. But it may include a longer wall in front or be of more pliable material or of lesser thickness.

According to a complementary typical feature, the pulling device is formed by an elastic loop, whose lateral traction straps are extensions of the respective lateral walls.

In a variation of the embodiment, the upper wall of the envelope is formed by the collection of two tongues, which are the respective extensions of corresponding lateral walls and which are solidly joined to each other by bonding means. Other characteristics and advantages of the invention are apparent from the description which follows relative to the attached drawings. These are provided only as examples but are not limited thereto.

BRIEF DESCRIPTION OF THE DRAWINGS

FIGS. 6, 7, and 8 are schematic views from above with partial drawing for views 7 and 8, showing the device in more detail, FIG. 6 being a view in the position of rest, FIG. 7 being a view of an intermediary position where the front of the boot is engaged, whereas FIG. 8 illustrates the retaining position.

FIG. 11 is a view similar to FIG. 3.

FIG. 12 is an illustration according to which the two upper tongues are disconnected.

FIGS. 13 and 14 are cross-sectional views according to two different width adjustments.

DETAILED DESCRIPTION OF THE DRAWINGS

Figure 1:
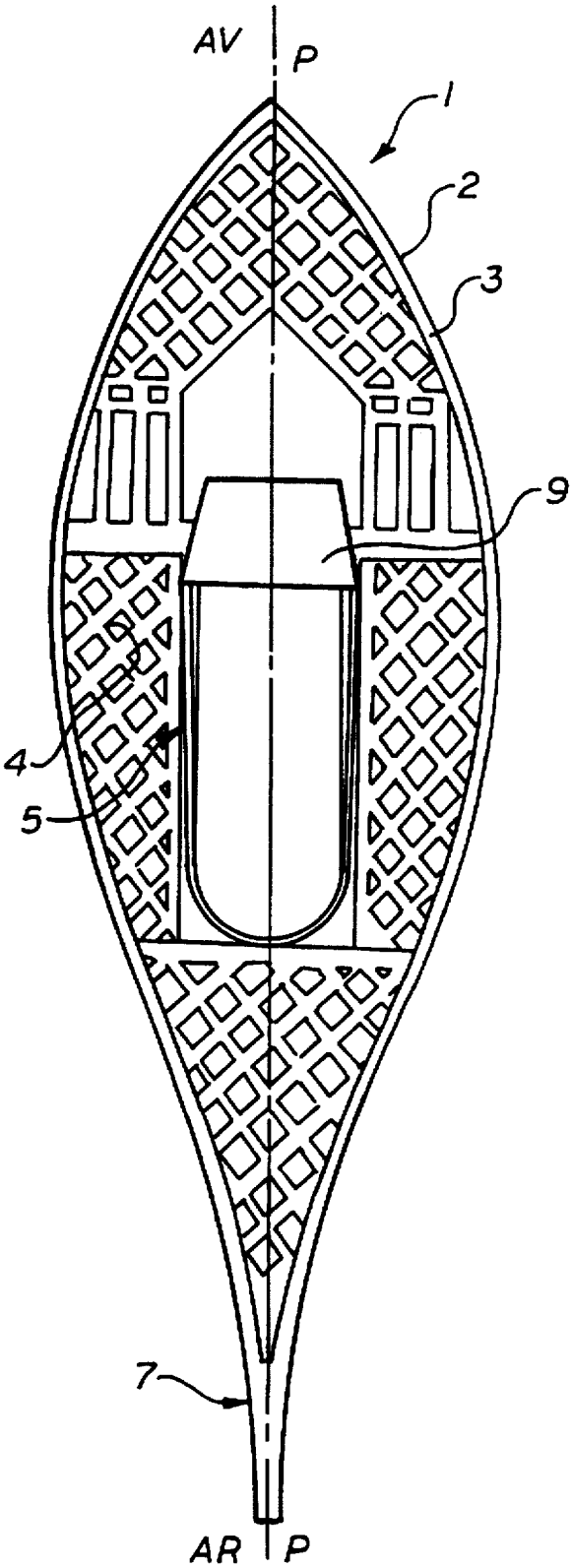
FIG. 1 is a view from above of a snow shoe equipped with the boot retaining device.
Figure 2:
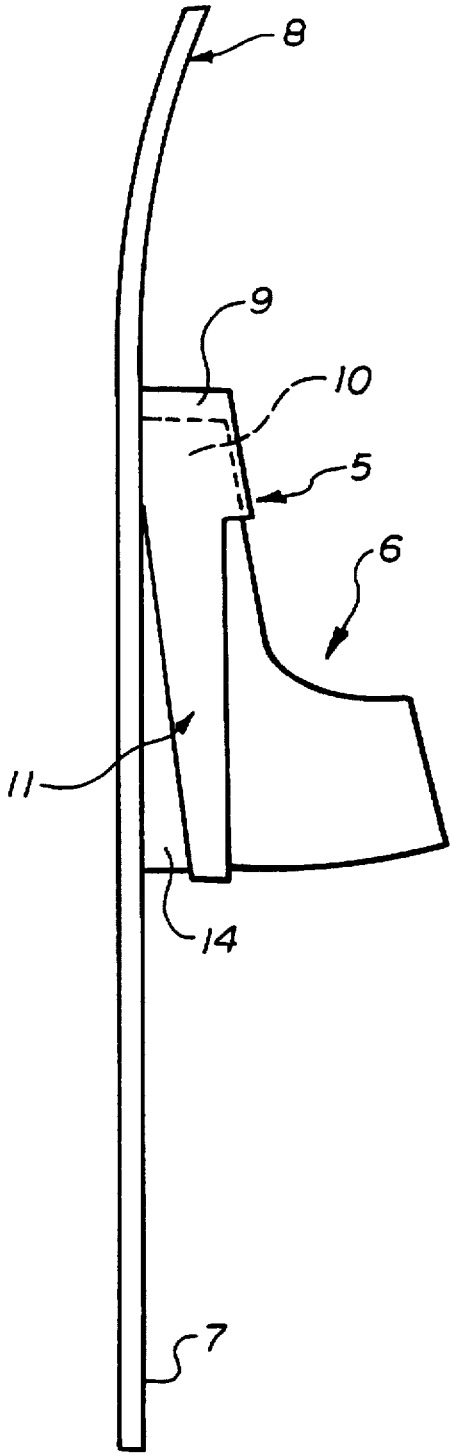
FIG. 2 is a lateral view with boot.
Figure 3:
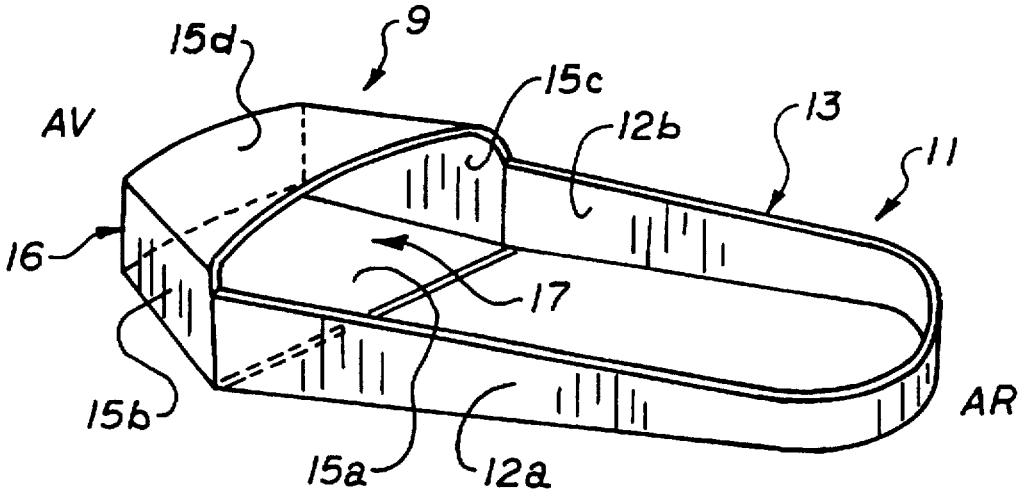
FIG. 3 is a rear view of the retaining device according to the invention.

The snow shoe intended to be equipped with the device according to the present invention, can, of course, be of any type, and for example of the type as is shown in FIGS. 1 and 2.

The snow shoe designed under general reference (1) is presented in form of a perforated plate of the general symmetry plane (P) fixed under the boot, and which is formed by a principal frame (2) made up by a peripheral wall (3) delimiting an interior zone (4) comprising a set of internal walls supporting the retaining device, more commonly called fixation (5) destined to retain the boot (6) of the user. Said principal frame has, for example, a general elongated form, which continues to the rear by a reduced width tail (7), while the front is raised and of slightly pointed shape in order to form the front spatula (8). Needless to say, the snow shoe can have any other form without going beyond the scope of the invention.

The boot (6) of the user is held to the snow shoe by the retaining device according to the invention, bearing general reference (5), and which is principally constituted by a front retaining device (9) wherein the front extremity (10) of boot (6) is retained. In addition, said boot is acted upon, toward the front (AV) in the front retaining organ (9) by a pulling device (11) in forward direction.

According to one of the embodiment modes of the invention, the retaining device (5) is a single-piece wall set, made of pliable material, such as rubber or elastomer. Thus, said device comprises the front retaining device (9) which is laterally extended, and toward the rear, by two pulling straps (12*a*, 12*b*) joining together to form a single-piece retaining loop (13) for the boot.

Figure 4:
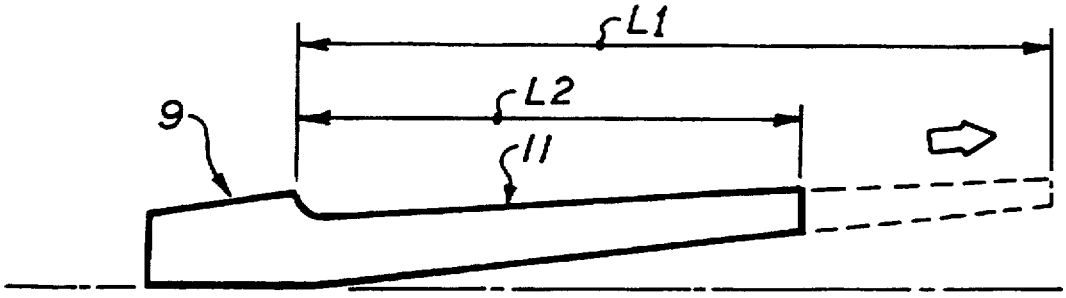
FIG. 4 is a lateral view of the retaining device in its resting position of non-utilization, with active retaining position indicated by interrupted lines.
Figure 5:
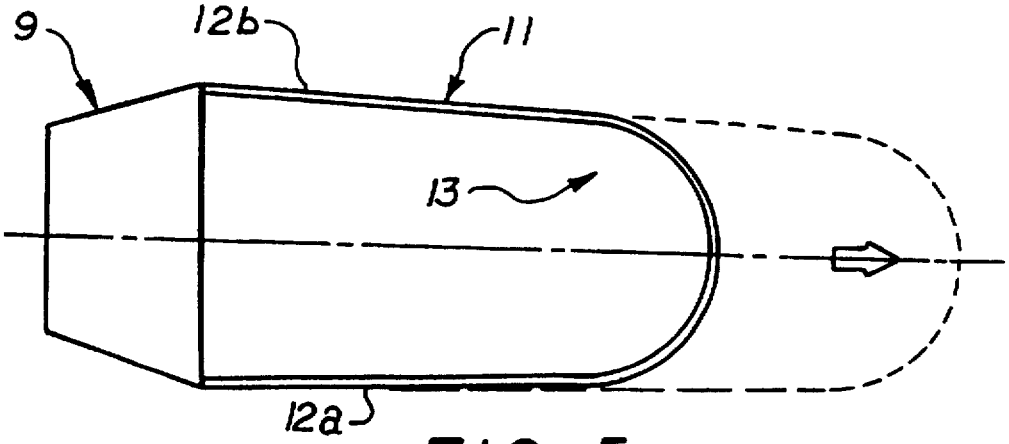
FIG. 5 is a view of the retaining device from above in its position of active utilization with active retaining position indicated by interrupted lines.
Figures 6, 7, 8:
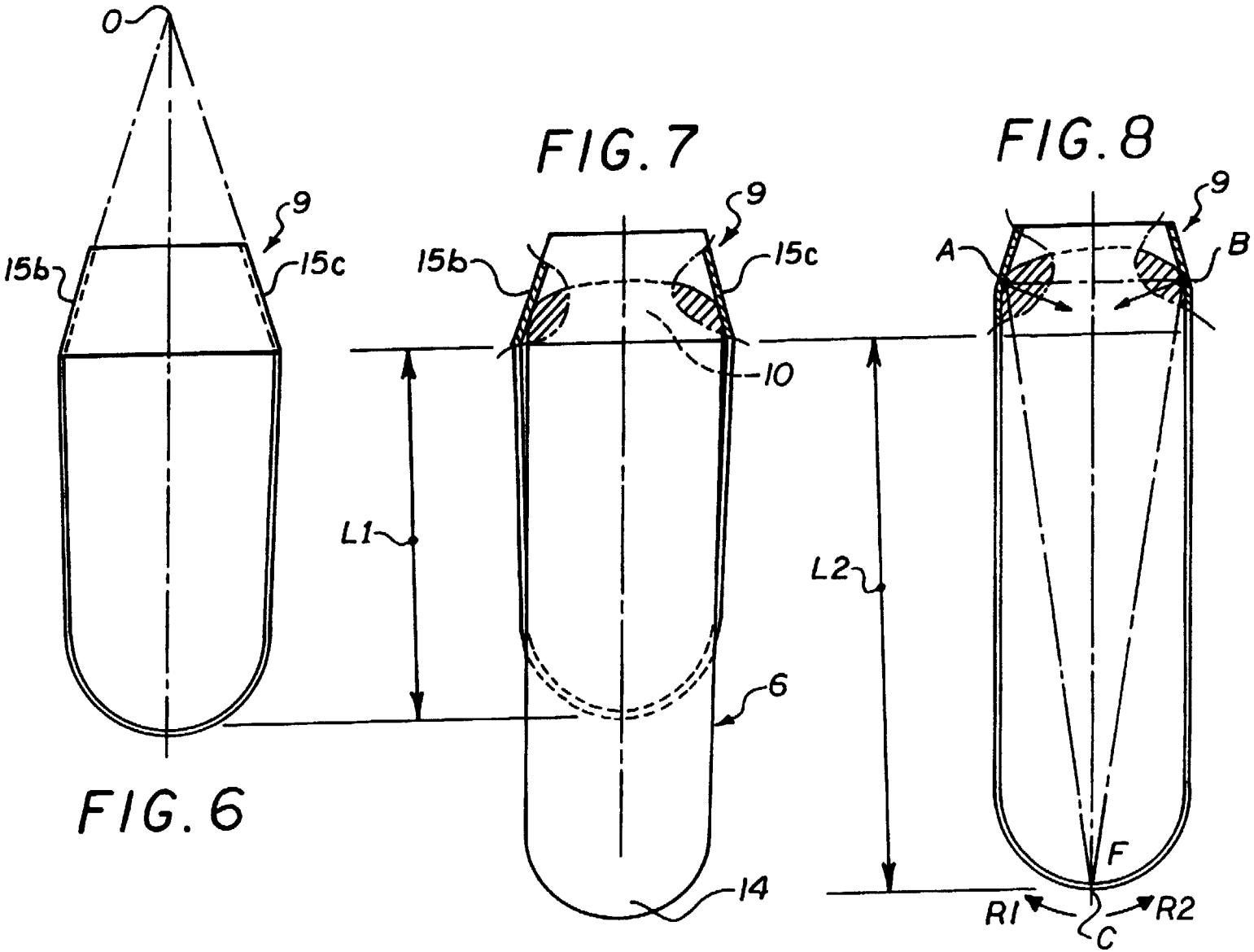
Figure 9:
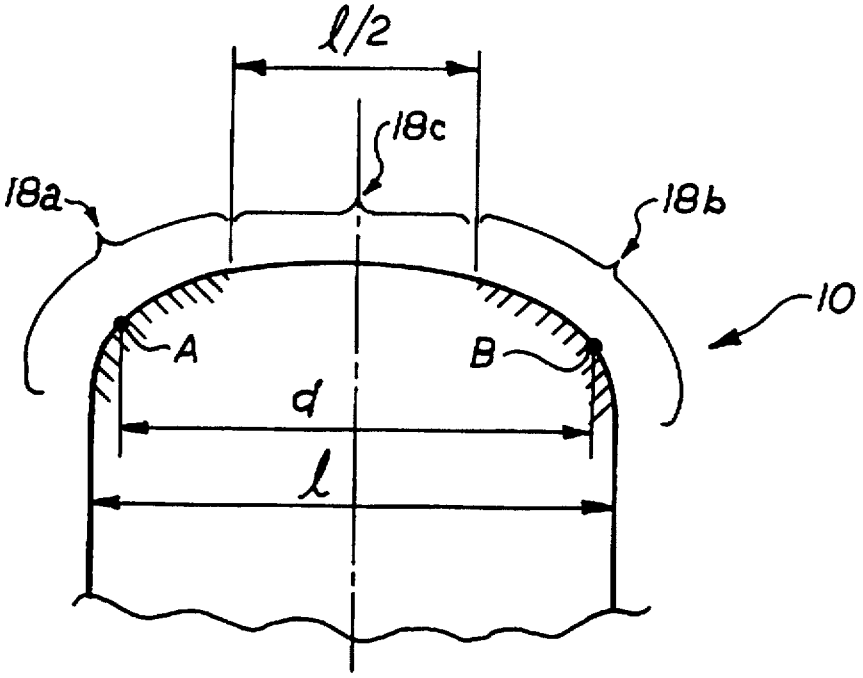
FIG. 9 represents in more detail the front extremity of the boot.

Said loop (13) being such that the pulling straps (12*a*, 12*b*) are arranged laterally at the boot to pass behind the heel (14) of same. It should be noted that in the retracted rest position, such as illustrated in FIGS. 4, 5, 6 and 7, the loop has a retracted length (L1), whereas in the retained position as shown in FIGS. 4, 5, and 8, its stretched out position (L2) is greater than its retracted length (L1). It is the elasticity of the material forming the loop which makes said extension possible and permits the loop to apply a force F on the heel of the boot, directed toward the front, which has the effect of pushing the boot toward the front and acting on its front extremity (10) in the front retaining device (9).

The front retaining device (9) is formed by a set of walls of pliable elastic and deformable material (15*a*, 15*b*, 15*c*, 15*d*), namely: a lower wall (15*a*), two lateral walls (15*b*, 15*c*) and an upper wall (15*d*), — the set of these walls thus constituting an elastic envelope (16), forming a cavity (17) at least open toward the rear (AR) wherein the front extremity (10) of the boot is engaged.

According to the invention, the two lateral walls (15*b*, 15*c*) are convergent toward the front in a point O and the lateral dimensions of the cavity (17) are such that the front extremity (10) of the boot is laterally maintained in two lateral points (A, B) separated by a distance (d). The distance (d) comprising, for example, between half of the width (1:2) of the boot and the width of same (1). It should be noted that the lateral walls (15*b*, 15*c*) are such that the front of the boot is retained as a matter of priority, indeed even exclusively, by its lateral zones (18*a*, 18*b*) and not by its front end center zone (18*c*). With such an arrangement, the boot is retained in an approximately horizontal plane according to three retaining points (A, B, C) forming a retaining triangulation which permits avoidance of all lateral pivoting of the rear retaining point C of the boot according to R1 or R2 and thus secures precise lateral hold of the boot on the snow shoe.

In order that the hold of the front part of the boot take place in the manner previously described, the front elastic envelope (16) advantageously comprises a frontal hole (19) in a manner so that the front central end zone (18*c*) of the boot cannot be located on the support in front of the envelope and so that the hold of the front of the boot take securely place in two lateral points A, B, according to the invention.

Figure 10:
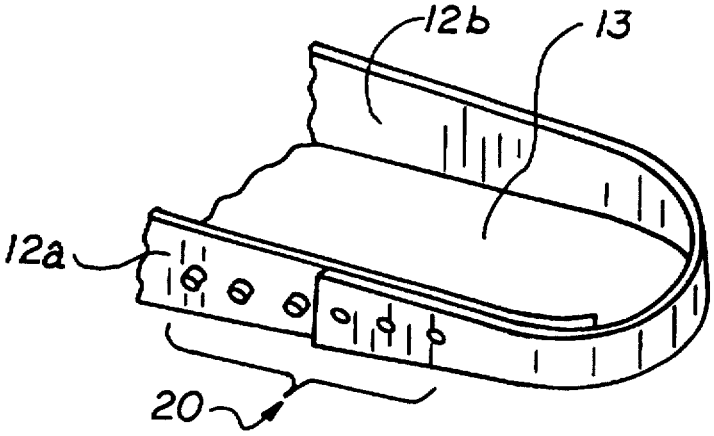
FIG. 10 is a variation of embodiment with adjustment.

Of course, the loop can have an adjustable length as is illustrated in FIG. 10. In such a variation, the strap forming the loop is in two rejoining parts, comprising a control system (20) which can be of any type and specifically as represented here by way of example. It should be noted that the rear retaining loop (13) is provided of elastic material, but may also be different. Thus, the strap or straps which form same can be of non-elastic material, but which is nevertheless pliable and deformable, comprising means of adjustment in length or only an elastic part.

Figure 11:
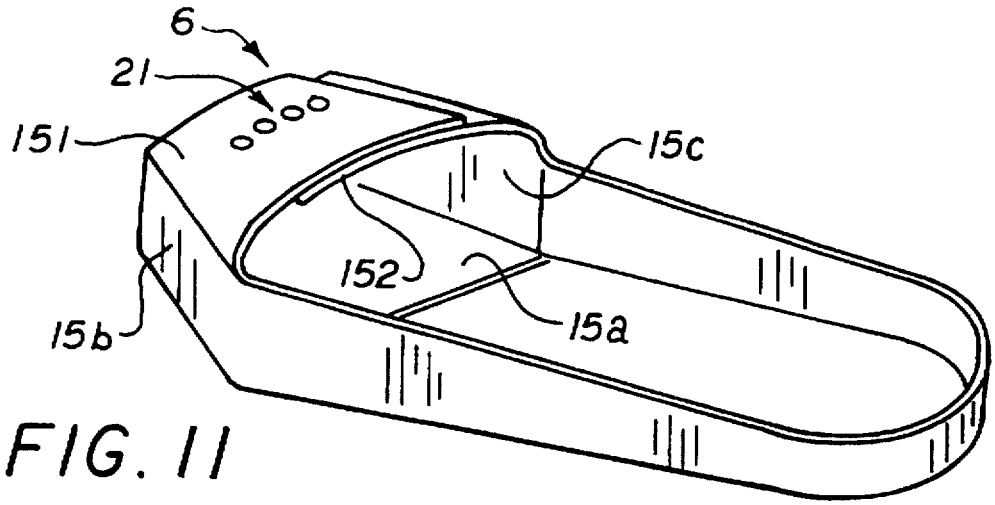
FIGS. 11, 12, 13 and 14 represent another embodiment.
Figure 12:
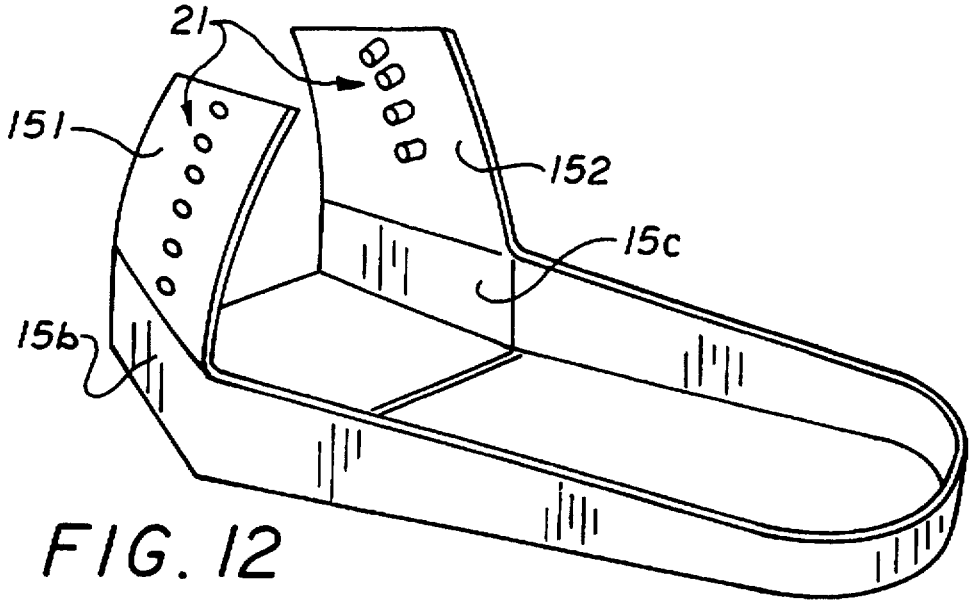
Figure 13:
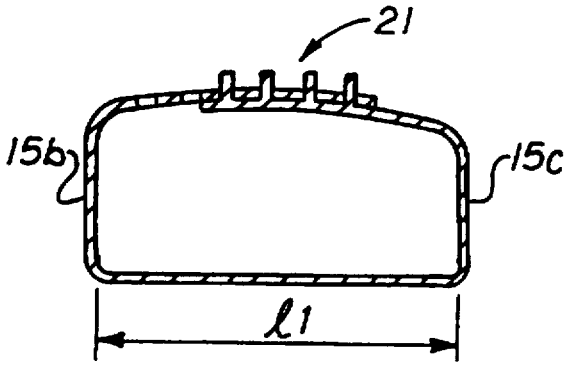
Figure 14:
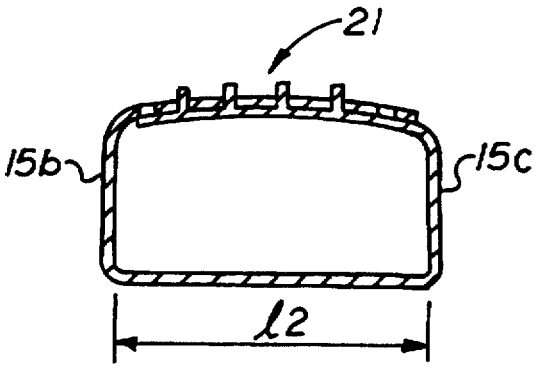

FIGS. 11 to 14 illustrate a variation of embodiment according to which the volume dimension and, specifically the width between the two lateral walls (15*b*, 15*c*) is adjustable. To that end, the upper wall (15*d*) is formed by the collection of two tongues (151, 152) joined to each other in adjustable manner by adjustable connection means (21). The first of the tongues (151) is formed by an extension of the first lateral wall (15*b*), whereas the second of the tongues (152) is formed by an extension of the second lateral wall (15*c*). Thus, while in retaining position, the two tongues join together, at least partially, as illustrated in FIGS. 11, 13 and 14, and, thanks to the adjustable connection means (21) it is possible to obtain greater or lesser joining of said tongues, thus guaranteeing the possibility of modifying the width between the two lateral walls according to the dimensions in width of the front end of the boot. FIGS. 13 and 14 show two possible adjustments of the width "11" and "12".

Figure 15:
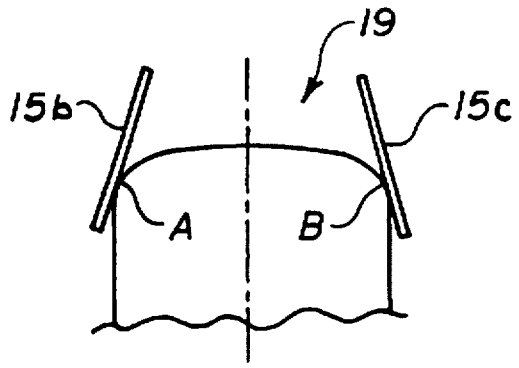
FIG. 15 illustrates a detail of the embodiment.
Figure 16:
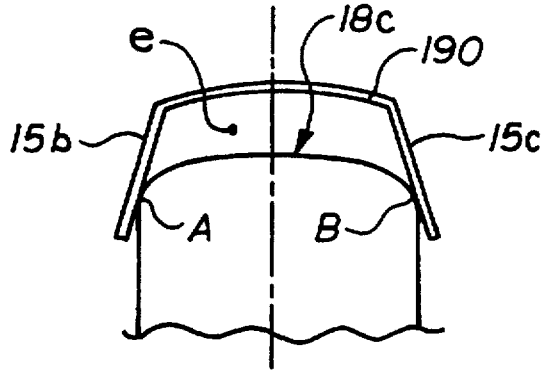
FIGS. 16 and 17 illustrate variations of embodiment.
Figure 17:
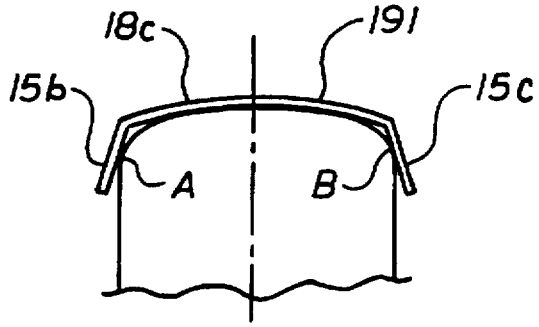

It is apparent that the lateral hold of the front end of the boot can be accomplished with a front envelope which includes a frontal hole (19) as represented in FIGS. 1 to 14 and in FIG. 15, but also with an envelope comprising a frontal wall (190), as illustrated in FIGS. 16 and 17. However, in the embodiment of FIG. 16, the frontal wall is sufficiently extended from the central front end zone (18*c*) so that there would be space (e) between said frontal wall (190) and the front (18*c*) of the boot.

FIG. 17 illustrates a variation of the embodiment according to which the envelope does not comprise the frontal hole (19) as previously, but an elastic, frontal wall (190) which is thinner than the thickness of the lateral walls (15*b*, 15*c*) in such manner that the central front end zone (18*c*) of the boot can support itself without said frontal wall exercising a significant force on the boot, or at least a significantly lower force.

Figure 18:
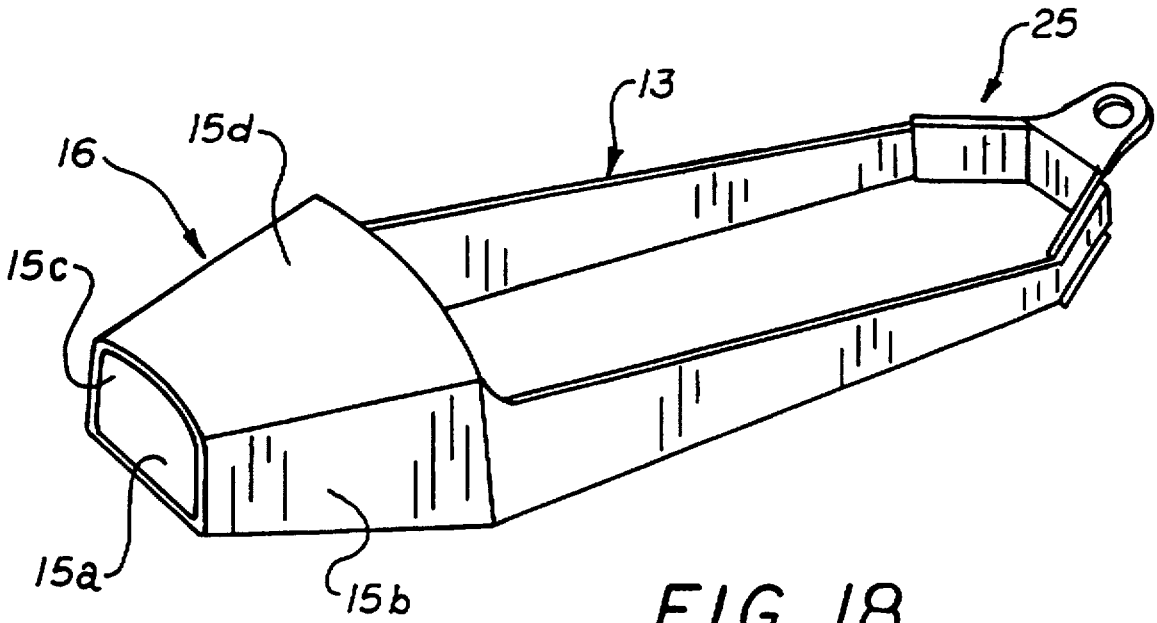
FIGS. 18 and 19 illustrate another embodiment.
Figure 19:
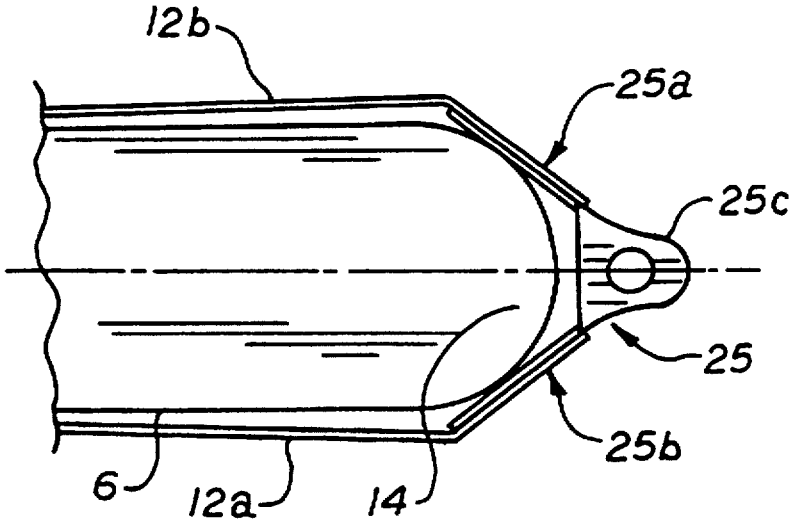

FIGS. 18 and 19 illustrate another variation of the embodiment according to which the pulling buckle (13) includes a piece of the rear embodiment (25) of rigid material such as plastic material. Said rear embodiment piece (25) being joined to the rear part of the elastic loop and comprising two lateral walls (25*a*, 25*b*) retaining the rear end of the boot. Moreover, said mentioned piece can advantageously include a gripping projection (25*c*) extending toward the rear (AR) permitting the user to pull more easily on the loop when putting on the shoes.

Of course, the invention is not limited to the execution modes described or represented by way of examples, but includes all equivalent techniques as well as their combinations.

Having described the preferred embodiment, my invention is now claimed to be:

1. A boot and snow shoe binding combination for retaining a boot comprising:

a boot having a blunt front toe defining a pair of opposite rounded corners and a heel toward a rear of the boot; and a snow shoe binding including:

a front retaining device which receives the front blunt toe of the boot, the front retaining device including an elastic envelope made up of a set of walls of pliable material which define a retaining cavity open toward the rear, the set of walls including a bottom wall, an upper wall, and two converging side walls which are spaced wider than the blunt toe of the boot at their rearward ends and which converge toward a spacing less than a spacing between the pair of rounded corners of the toe of the boot at their forward ends such that the front extremity of the boot is received in the front retaining device with the pair of rounded corners defining two lateral retaining points of contact with the two converging side walls;

a pulling device extending from the elastic envelope around the heel of the boot to bias the boot in a forward direction such that the pair of rounded corners which define the two lateral retaining points of contact at the toe of the boot are urged into firm frictional contact with the two converging side walls and the pulling device defines a third retaining point with the heel of the boot, the first, second, and third retaining points defining a triangle to inhibit lateral movement of the heel of the boot.

2. The boot and snow shoe binding combination according to claim 1 wherein the two lateral retaining points on the rounded corners of the toe of the boot are spaced between a half a width of the boot and the width of the boot.

3. The boot and snow shoe binding combination according to claim 1 wherein the front extremity of the boot includes a central front end zone and a pair of oppositely disposed lateral zones extending from the front end zone to opposite sides of the boot, the lateral zones each including one of the two lateral retaining points that engage the two converging side walls.

4. The boot and snow shoe binding combination according to claim 1 wherein the elastic envelope is open between forward ends of the convergent side walls.

5. The boot and snow shoe binding combination according to claim 1 wherein the elastic envelope includes a frontal wall connected with the two converging side walls and disposed such that there is a space between the blunt toe of the boot and the frontal wall.

6. The boot and snow shoe binding combination according to claim 1 wherein the elastic envelope includes a frontal wall connected between the converging side walls, which frontal wall is thinner than the converging side walls.

7. The boot and snow shoe binding combination according to claim 1 wherein the pulling device includes an elastic loop which is integrally connected with the two converging side walls.

8. The boot and snow shoe binding combination according to claim 7 wherein the elastic loop includes a length adjusting construction.

9. The boot and snow shoe binding combination according to claim 1 wherein the upper wall of the set of walls which defines the retaining cavity is formed by two tongues, each of which is an integral extension of one of the converging side walls, the two tongues being joined with each other by an interconnection system.

10. The boot and snow shoe binding combination according to claim 9 wherein the interconnection system is adjustable such that a width of the upper wall is adjustable.

11. The boot and snow shoe binding combination according to claim 7 further including a rigid fitting connected with the rear of the elastic loop.

12. In combination a snow shoe binding and boot, the combination comprising:

a boot having a blunt front toe which defines first and second retaining points and a heel which defines a third retaining point, the first and second retaining points being spaced between a half a width of the boot and the width of the boot, such that the first, second, and third retaining points define a triangle;

a snow shoe binding for engaging the first, second, and third retaining points to define a triangular engagement which inhibits lateral movement of the heel of the boot, the snow shoe binding including:

an elastic envelope which defines a retaining cavity for receiving and engaging the blunt toe of the boot, the elastic envelope including a bottom wall, an upper wall, and a pair of linear converging side walls such that the toe retaining cavity is trapezoidal, the two converging side walls being spaced wider than the first and second retaining points at their rearward ends and being spaced less than the first and second retaining points at their forward ends such that as the blunt toe of the boot is received in the trapezoidal retaining cavity, the first and second retaining points are cammed into tight frictional contact with the two converging side walls;

a strap extending from one side of the elastic envelope, around the heel of the boot, to the other side of the elastic envelope such that the strap frictionally engages the third retaining point on the heel of the boot inhibiting sliding movement between the strap and the heel of the boot and such that the strap urges the first and second contact points into firm frictional contact with the converging side walls.

13. The snow shoe binding and boot combination as set forth in claim 12 wherein the elastic envelope is open between the converging side walls adjacent the toe of the boot such that a central portion the toe of the boot does not engage the elastic envelope.

14. The snow shoe binding and boot combination as set forth in claim 12 wherein the elastic envelope further includes a front wall connected between the converging side walls, the front wall being displaced from the blunt toe of the boot.

15. In combination a boot and snow shoe binding, the combination comprising:

a boot having a front toe and a heel;

a snow shoe binding for engaging first and second retaining points on the front toe of the boot and a third retaining point on the heel of the boot such that a triangle of engagement points is defined to inhibit lateral movement of the heel of the boot, the snow shoe binding including:

an elastic envelope which defines a retaining cavity for receiving the front toe of the boot, the elastic envelope including a bottom wall, a top wall, a pair of converging side walls connected between the bottom and upper wall, and a front wall region defined between a front end of the pair of converging side walls, the two converging side walls each engaging the front toe of the boot at one of the first and second retaining points, the two converging side walls being spaced wider than the first and second retaining points at their rearward ends and being spaced less than the first and second retaining points at the their front ends, the front wall region being displaced from the front toe of the boot such that the front toe of the boot is free from engagement with the elastic envelope between the first and second retaining points;

a strap extending from one side of the elastic envelope, around the heel of the boot, to the other side of the elastic envelope such that the strap frictionally engages the heel of the boot at the third retaining point and urges the boot forward such that the front toe of the boot frictionally engages the two converging side walls at the first and second retaining points.

16. The boot and snow shoe binding combination as set forth in claim 15 wherein the toe of the boot has a width and the first and second retaining points are spaced from each other by less than the width of the front toe and more than a half of the width of the front toe.

17. The boot and snow shoe binding combination as set forth in claim 16 wherein the front wall region the elastic envelope is open.

* * * * *